United States Patent [19]

Ochs et al.

[11] 3,945,583

[45] Mar. 23, 1976

[54] REWIND SHAFT

[75] Inventors: Gordon M. Ochs, Washougal, Wash.; Raymond L. Wheeler, Independence, Mo.

[73] Assignee: Tidland Corporation, Camas, Wash.

[22] Filed: Oct. 10, 1974

[21] Appl. No.: 513,651

[52] U.S. Cl. ..... 242/56.9; 242/68.4; 242/72 B

[51] Int. Cl.[2] ..... B65H 19/04; B65H 75/24

[58] Field of Search ..... 242/56.9, 56.2, 68, 68.4, 242/72 R, 72 B, 129.6, 129.62

[56] References Cited

UNITED STATES PATENTS

| | | | |
|---|---|---|---|
| 2,711,861 | 6/1955 | Heygel et al. | 242/68 X |
| 3,339,857 | 9/1967 | Knibbs et al. | 242/56.9 X |
| 3,391,878 | 7/1968 | Naccara | 242/72 B |

*Primary Examiner*—Stanley N. Gilreath
*Assistant Examiner*—John M. Jillions
*Attorney, Agent, or Firm*—Klarquist, Sparkman, Campbell, Leigh, Hall & Whinston

[57] ABSTRACT

An improved rewind shaft of a web slitting machine has a long shaft portion supporting cores which are held in exact positions and against movement along the shaft by a retaining sleeve held against longitudinal movement relative to the rewind shaft by an expansible air shaft segment forming a detachable end portion of the rewind shaft.

4 Claims, 4 Drawing Figures

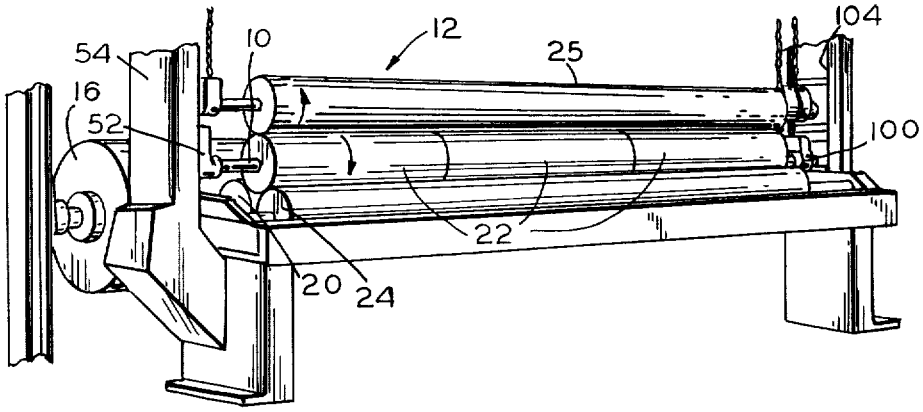
FIG. 1
FIG. 4
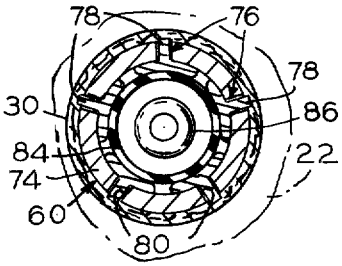
FIG. 2
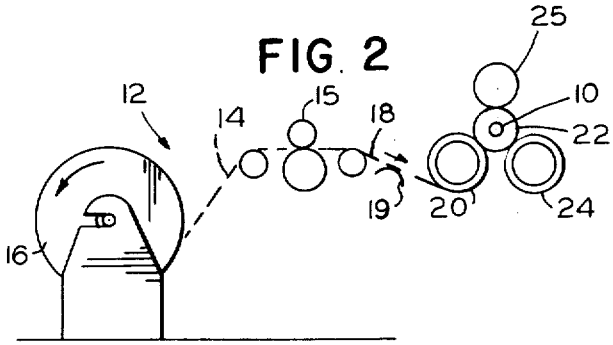
FIG. 3
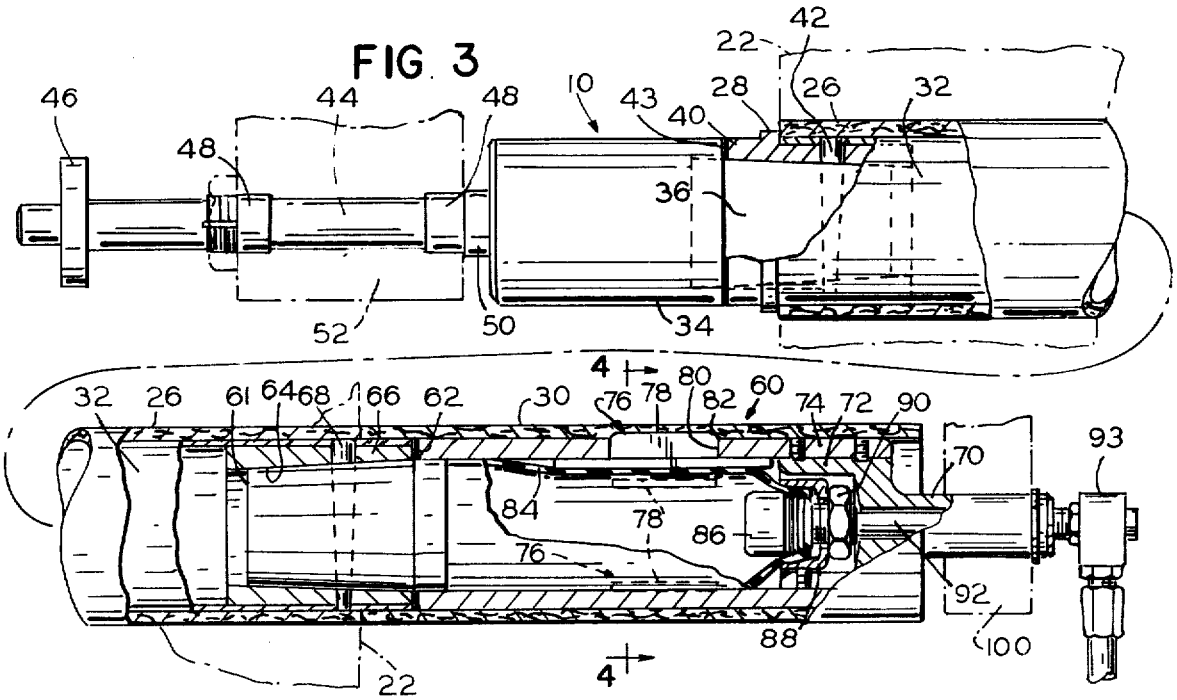

REWIND SHAFT

This invention relates to an improved rewind shaft, and has for an object thereof the provision of an improved rewind shaft.

Another object of the inventin is to provide a rewind shaft having a detachable journal and core retainer end segment.

A further object of the invention is to provide a hybrid air shaft construction including a long bar portion which slidably mounts rewind cores, and also including a short air shaft and journal segment which holds a retainer sleeve in engagement with the adjacent one of the cores.

Another object of the invention is to provide a combined chucking and journaling segment attachable to an end of a rewind bar.

In the drawings:

FIG. 1 is a fragmentary perspective view of a paper web slitting machine including an improved rewind shaft forming one embodiment of the invention;

FIG. 2 is a schematic view of the machine of FIG. 1;

FIG. 3 is an enlarged, fragmentary, partially sectional view of the improved rewind shaft of FIG. 1; and FIG. 4 is an enlarged, vertical sectional view taken along line 4—4 of FIG. 3.

Referring now in detail to the drawings, there is shown therein a paper web slitting machine including an improved rewind shaft 10 forming one embodiment of the invention and forming a part of a two-drum and riding roll surface wind system 12. A paper web 14 is advanced from an unslit supply roll 16 through rotary shears 15, and the several resulting slit webs 18 travel over a bow spreader 19 and under driving drum 20 and are wound on the rewind shaft 10 to form rolls 22, a second driving drum 24 also serving to support and rotate the rolls 22. A known, counterweighted pressing roll 25 engages the rolls 22. More specifically, the rolls 22 are wound on cores 26 (FIG. 3) which are coextensive in lengths with the lengths of the respective rolls 22 thereon, and may be formed of fiber, steel or other materials.

The fiber cores 26 are held against substantial movement along the shaft 10 by a collar 28 of a journaling and segment 34 and a retaining sleeve 30, which mag be a random length piece of salvage or scrap core, like the cores 26. The sleeve 30 and collar 28 hold the cores 26 in exact positions on the shaft 10. The shaft 10 includes a long tube or bar 32 to one end of which the end segment 34 is detachably secured. The end segment 34 has a reduced tapered end portion 36 press fitted into a bushing 40 fixed to the bar 32. The end segment 34 is detachably secured by a tapered pin 42 to the tube 32, shims 43 controlling the press fit. The end segment 34 has a journal portion 44 and a pulling collar 46. The journal portion has collar portions 48 larger than the central portion of the journal and an even larger stop portion 50. The collar portions fit in a known, quick releasable bearing structure 52 movable along a known vertical guide structure 54, as is well known in the art.

The shaft 10 also includes a short, expansible shaft segment 60 which may be an air shaft or chuck having a tapered end portion 61 breakaway fitted into complementary, tapered socket 64 in a bushing 66 welded to the tube 32. Shims 62 between the ends of the tube 32 and a sleeve 74 of the air shaft permit just the desired extent of jamming of the tapered end portion 61 in the socket 64. A tapered pin 68 locks the bushing to the tube and to the tapered portion 61.

An alternate structure for locking the shaft segment 60 to the tube 32 comprises providing American Pipe Institute locking threads on the portion 61 and in the tapered socket 64.

A tubular journal portion 70 has an enlarged end portion 72 press-fitted into the sleeve 74 of the air shaft. The air shaft also includes internal leaf and lug assemblies 76 having lugs 78 (or other gripping members) projecting through slots 80 in the sleeve 74. The lugs have rounded end or corner portions 82. A rubber tube 84 plugged at one end and sealed to a female tube fitting 86 and an end cap 88, when supplied with air under pressure, expands to press the lugs 78 radially outwardly into locking engagement with the retaining sleeve 30. When the pressure on the air in the tube 84 is relieved, the tube contracts radially and the lugs are free to move radially inwardly to positions flush with the outer periphery of the sleeve 74.

A nut 90 screwed onto the fitting 86 presses the cap 88 into clamping engagement with the end portion of the rubber tube 84. A pipe 92 screwed into tapped end portion of the fitting 86 is connected by a detachable rotary coupling 93 and a known manually operable valve structure (not shown) which is connected to a source of air under pressure. The valve structure may be selectively set in an operating condition which connects the air under pressure to the rubber tube or a release condition connecting the rubber tube to atmosphere. In place of the rotary coupling 93, the pipe 92 may be provided with an end fitting valve like a tire valve for receiving air under pressure.

In a slitting operation, with the air shaft exhausted, the fiber cores 26 and the retaining sleeve 30 are slid onto the air shaft 10 and snugly pressed against each other and the collar 28, which forms a reference shoulder or edge. The valve structure (not shown) then is set manually in its operating condition, and air under pressure is supplied to the interior of the rubber tube 84. The tube 84 expands to press the lugs 78 into locking engagement with the retaining sleeve 30 to hold the sleeve 30 and the cores 26 against endwise movement. The shaft is then placed in the bearing 52 and in a similar, known, quick-release bearing structure 100 which is movable along a known vertical guide 104 of the paper web slitting machine. The ends of the slit webs 18 are attached to the cores 26, and the drums 20 and 24 are rotated to rotate the shaft and the portions of the slit webs 18 on the shaft to take up the webs as they are formed by slitting the web 14. After the slitting is completed, the shaft 10 with the rolls 22 thereon is removed from the machine after the bearing structure 52 and 100 are released. Then, the valve structure is actuated to release the air pressure in the rubber tube 84, and the shaft 10 is pulled out of the rolls 22, the pulling collar 46 being used.

The rewind shaft 10 holds the cores 26 securely in precise positions thereon, the cores being on the bar 32 whose length is many times the lengths of the short segments 34 and 60. The segments 34 and 60 may be easily detached from the bar 32 for replacement or repair, and the sleeve 30 may be a short length of scrap core material.

I claim:

1. In a rewind shaft, an elongated tube of a predetermined length having a first end and a second end, a first journal means detachably secured to the first end of the tube, a stop collar on the first journal means projecting radially beyond the outer periphery of the tube, an expansible shaft segment of a length a small fraction of that of the tube, attachment means releasably securing the shaft segment to the second end of the tube, and a second journal means secured to the shaft segment at an end thereof remote from the tube, a sleeve for holding a series of fiber cores on the tube between the sleeve and the stop collar, the expansible shaft segment serving to hold said sleeve against endwise movement relative to said tube, whereby said fiber cores are held against endwise movement.

2. The rewind shaft of claim 1 wherein the expansible shaft segment comprises an expansible air shaft segment.

3. The rewind shaft of claim 2 wherein the air shaft includes a plurality of radially expansible lugs and an expansible tube for pushing the lugs outwardly into engagement with the sleeve.

4. The rewind shaft of claim 1 wherein the attachment means includes an internally threaded bushing fixed rigidly in the tube, an externally threaded end member fixed rigidly to the expansible shaft segment and threadedly engaging the internally threaded bushing.

* * * * *